United States Patent [19]

Rowe, Jr. et al.

[11] 4,118,253

[45] * Oct. 3, 1978

[54] NON-FLAMMABLE SOLVENT PHOSPHATIZING COMPOSITIONS YIELDING NON WATER SOLUBLE COATINGS

[75] Inventors: Edward A. Rowe, Jr., Mentor; William H. Cawley, Painesville, both of Ohio

[73] Assignee: Diamond Shamrock Corporation, Cleveland, Ohio

[ * ] Notice: The portion of the term of this patent subsequent to Jun. 14, 1994, has been disclaimed.

[21] Appl. No.: 755,680

[22] Filed: Dec. 30, 1976

Related U.S. Application Data

[63] Continuation-in-part of Ser. No. 560,377, Mar. 20, 1975, Pat. No. 4,029,523.

[51] Int. Cl.[2] ..... C23F 7/10

[52] U.S. Cl. ..... 148/6.15 R; 148/6.17; 148/6.16

[58] Field of Search ..... 148/6.15 R, 6.15 Z, 148/6.2, 6.17

[56] References Cited

U.S. PATENT DOCUMENTS

| | | | |
|---|---|---|---|
| 3,197,345 | 7/1965 | Vullo et al. | 148/6.15 R |
| 4,029,523 | 6/1977 | Rowe et al. | 148/6.15 R |

*Primary Examiner*—Ralph S. Kendall

*Attorney, Agent, or Firm*—John J. Freer

[57] ABSTRACT

A liquid phosphatizing composition, containing organic solvent such as 1,1,1-trichlorethane or trichlorofluoromethane, can provide phosphate coatings on metal articles. In addition to the organic solvent, the composition contains a phosphatizing proportion of phosphoric acid and a solubilizing liquid capable of solubilizing phosphoric acid in the organic solvent. The composition contains a minor amount of water, yet it is an amount exceeding the proportion of phosphoric acid, and the composition is non-flammable. Phosphatized coatings of desirable water insolubility are obtained.

8 Claims, No Drawings

NON-FLAMMABLE SOLVENT PHOSPHATIZING COMPOSITIONS YIELDING NON WATER SOLUBLE COATINGS

CROSS-REFERENCE TO RELATED APPLICATION

This application is a continuation-in-part of U.S. application Ser. No. 560,377, filed Mar. 20, 1975 now U.S. Pat. No. 4,029,523.

BACKGROUND OF THE INVENTION

Phosphatizing operations carried on in water have typically provided drawbacks, including sludging and the need for a multistep operation, to achieve dry, coated articles. In an early attempt to overcome such problems, as described in U.S. Pat. No. 2,515,934, from 1 to 7% of the commercial phosphoric acid 85% syrup was used in an organic mixture, rather than in water. Representative of these mixtures was a 50/50 blend of acetone and carbon tetrachloride. With the blend, only a few steps were needed for phosphatizing.

In subsequently developed operations, a metal article for phosphatizing might be dipped in a chlorinated hydrocarbon degreasing solution, then come in contact with a non-aqueous phosphatizing solution, and thereafter be returned to the chlorinated hydrocarbon degreasing solution for a final rinse operation. Such operation has been described for example in U.S. Pat. Nos. 3,100,728 and 3,197,345. As also discussed in the U.S. Pat. No. 3,197,345, it was becoming recognized that there was a water-based process, also called an "aqueous" method of phosphatizing metal articles, and on the other hand a solvent-based process, which was therein noted as the "dry" process. The latter process typcially employed a solution of phosphoric acid in a chlorinated hydrocarbon solvent. Since the compositions of the U.S. Pat. No. 3,197,345 relied on chlorinated hydrocarbons, the phosphatizing method used was the "dry" process and the useful compositions were substantially water-free compositions.

Special organic phosphate complexes could be useful in the non-aqueous solutions. They had the advantage of providing protective coatings of enhanced corrosion resistance. This approach was taken in U.S. Pat. No. 3,249,471. Another approach to the dry process, or to the "non-aqueous" process as it was also called, and that was employed in U.S. Pat. No. 3,297,495, was the use of a high strength acid. In such patent, the acid used was preferably one of 96–100% phosphoric acid. This concentrated acid presented sludge problem, but these were overcome by employing special additives.

More recently, as discussed in U.S. patent applications Ser. Nos. 560,377 and 560,378, now U.S. Pat. Nos. 4,029,523 and 4,008,101, respectively, water resistant coatings have been achieved from organic phosphatizing compositions. Such compositions can be most desirably based on methylene chloride and further may contain a few percent or more of water without losing liquid phase homogeneity.

A variation in the prior art efforts involves the addition of a stabilizing agent to a coating bath to prolong the formation of adherent coatings from the bath. In West German Pat. No. 1,222,351, the use of an agent such as dimethyl glyoxime, as a stabilizer, has been shown. The baths, even with stabilizer, are of dubious quality without the use of commercial ethanol. This necessarily introduces a minor amount of water into the coating composition. However, emphasis is on higher boiling solvents, and even with commercial ethanol, resulting compositions can be dangerously flammable.

SUMMARY OF THE INVENTION

It has been found that a chlorinated hydrocarbon phosphatizing composition can produce highly desirable coatings. Such coatings, even containing a higher boiling solvent and when further having only very minor amount of water, are achieved with non-flammable compositions. Wherein water is not present in sufficient amount to provide a liquid composition that does not retain liquid phase homogeneity. Moreover, other desirable coating characteristics are not deleteriously affected.

Broadly, the invention is directed to a non-flammable organic phosphatizing composition having a continuous and homogeneous liquid phase suitable for phosphatizing metal with a coating of at least substantial water insolubility, with the liquid phase containing water in minor amount. The composition comprises halogenated organic solvent providing liquid phase homogeneity with an organic solubilizing liquid, while being a non-solvent for a phosphatizing proportion of phosphoric acid in the composition. The halogenated organic solvent is unreactive with phosphoric acid in the composition and has halogens selected from the group consisting of chlorine, flourine and mixtures thereof. The composition further comprises solubilizing liquid capable of solubilizing phosphoric acid in the composition, while retaining liquid phase composition homogeneity. The solubilizing liquid is unreactive with phosphoric acid in the composition, and either has a boiling point greater than the boiling point of the halogenated organic solvent, or forms an azeotrope with the halogenated organic solvent. The azeotrope must boil at a point below the boiling point of the solubilizing liquid and contain above about 80 mole percent of the halogenated organic solvent. Further, the composition comprises a phosphatizing proportion of phosphoric acid; and, contains water in an amount exceeding such proportion of phosphoric acid, while being sufficient for the composition to provide a phosphatized coating of substantial water insolubility on a ferrous metal substrate in phosphatizing contact with the composition, and while retaining liquid phase homogeneity.

DESCRIPTION OF THE PREFERRED EMBODIMENTS

The halogenated organic solvent, or "solvent constituency" as it is sometimes referred to herein, is typically commercially available material and may contain additional ingredients, although the use of more purified substance is contemplated. For example, commercial 1,1,1-trichlorethane may contain very minor amounts of stabilizers such as 1,2-butylene oxide, nitromethane and 1,4-dioxane. It is further contemplated to use blends of halogenated organic solvents. Alone or in combination, these solvents are such as will not solubilize a phosphatizing proportion of phosphoric acid; this phosphoric acid insolubility will be characteristic of the solvent even at the boiling point, as for example of the azeotrope, at normal pressure. For suitable acid solubility, a solubilizing liquid is needed. The halogenated organic will generally provide the major amount of the phosphatizing solution and will typically provide between about 60 to about 90 weight percent of such solution. It is most preferable, for efficient phosphatizing composition preparation, that the halogenated organic solvent and the solubilizing liquid form storage stable blends. That is, that they form blends that on extended storage are free from phase separation.

Most preferably for efficient operation, the halogenated organic solvent is liquid at normal pressure and temperature and has a boiling point at normal pressure above about 35° C. Solvents that are contemplated for use are the chlorinated solvents such as 1,1,1-trichlorethane and the flourine-containing hydrocarbon solvents, e.g., trichlorofluoromethane. Other useful organic solvents in addition to those already mentioned, and which can or have been used, include chloroform, 1,1,3-trichlorotrifluoroethane, perchloroethylene, trichloroethylene, and 1,1,2,2-tetrochloro-1,2-difluoroethane, as well as the inert and homogeneous liquid mixtures, of all the solvents mentioned herein, where such exist, as for example azeotropic mixtures. By being inert, it is meant that such mixtures do not chemically react with one another, or with other substituents of the phosphatizing composition, so as to retard or interfere with desirable phosphatizing operation of the composition. This characteristic of being inert carries through even at the temperature attained for the solution to be at boiling condition.

The solubilizing liquid needs to be one or a mixture that is capable of solubilizing phosphoric acid in the organic solvent while retaining composition homogeneity. The solubilizing liquid can also affect other characteristics of the phosphatizing solution, e.g., it may have an effect on the solubility of water in the phosphatizing solution. It is advantageous that the solubilizing liquid be capable of being readily blended into the phosphatizing composition and that it be unreactive with phosphoric acid, i.e., not chemically react with the acid even at the composition temperatures achieved during phosphatizing operation. The solubilizing liquid will have a boiling point higher than the boiling point of the halogenated organic solvent, or on boiling it will form an azeotrope with such solvent. The solubilizing liquid can be, and on occasion most desirably is, a blend of organic substances. Such blends are particularly useful for augmenting the solubility of water in the phosphatizing solution.

Particularly where the phosphatizing solution will be used as a liquid phosphastizing bath, at elevated temperature, thereby forming a rinse zone immediately above the bath that conatins constituents of the bath in vapor state, it is desirable that some solubilizing liquid be present in such vapor. When phosphatized metal articles are removed from the phosphatizing bath into such rinse zone, one ingredient that may be present on the article for rinsing is phosphoric acid. Since the halogenated organic solvent even as a vapor in the rinse zone will exert little solubilizing activity towards the phosphoric acid, it is desirable to have vapor from the solubilizing liquid also present in the rinse zone.

To maintain the necessary non-flammable characteristic of the phosphatizing composition, the halogenated organic solvent will be the predominant constituent of the vapor zone. In one way this can occur by selecting the solubilizing liquid to have a boiling point higher than the boiling point of the halogenated organic solvent. Alternatively, such liquid plus solvent will azeotrope, and the azeotrope will boil at a point below the boiling of the solubilizing liquid. Further, the azeotrope should provide in the vapor zone above about 80 mole percent of the halogenated organic solvent to maintain the non-flammability characteristic. Preferably, for best suppression of flammability, such zone will contain above about 90 mole percent of halogenated organic solvent.

Most advantageously for efficiency of operation the solubilizing liquid is an alcohol having less than six carbon atoms. Alcohols of six carbon atoms or more may be used, but should always be present in minor amount with at least one less than six carbon atom alcohol being in major amount. Representative alcohols that can be or have been used include methanol, ethanol, isopropanol, n-pentanol, n-propanol, n-butanol, allyl alcohol, sec-butanol, tert-butanol and their mixtures wherein liquid phase homogeneity is maintained when in mixture with halogenated organic solvent. However, additional substances, e.g., 2-butoxyethanol, can also be serviceable, alone or in combination with alcohol.

As discussed hereinabove, phosphoric acid will have only an extremely limited solubility in the organic solvent. However, this situation is obviated by using the solubilizing liquid. Therefore, although the phosphoric acid is a critical ingredient that is generally present in a very minor amount, with the solubilizing liquid present in the phosphatizing solution the phosphoric acid may be contained in the phosphatizing solution in substantial amount. Such amount might be up to 2–3 weight percent or more. But, for efficient and economical coating operation, the phosphoric acid is generally used in an amount below about one weight percent, basis total weight of the phosphatizing composition. A much greater amount than about 1%, will typically leave a coating on the metal substrate that is tacky to the touch. Preferably, for most efficient coating operation, the phosphoric acid is present in an amount between about 0.2–0.8 weight percent, basis the phosphatizing solution, although an amount below even 0.1 weight percent can be serviceable.

If it is contemplated that the phosphatizing solution will be used for the coating of metals that have been heretofore recognized as susceptible to phosphatizing, i.e., capable of readily reacting with phosphoric acid. Thus, it is contemplated that the phosphatizing solution will be useful for phosphatizing aluminum, zinc, cadmium and tin substrates as well as the more typical ferruginous metal substrates. The "phosphatizing proportion of phosphoric acid", as such term is used herein, may well be a "phosphatizing substance", as it might more appropriately be termed. That is, the use of such terms herein is not meant to exclude any substances that may be, or have been, useful in the solvent phosphatizing art for providing a phosphate coating. Such substances might thus include organic phosphate substance as well as the more typical acidic substances of phosphorous, e.g., the usual orthophosphoric acid. Further, it is contemplated that such substance include salts of such acids in phosphatizing. Since water is present in the phosphatizing solution in amounts greater than the phosphatizing substance, although concentrated acids are contemplated, e.g., phospholeum, the resulting solution contains the acid in dilution in water. Preferably, for economy, the orthosphosphoric acid is always the phosphoric substance used in the phosphatizing solution.

As mentioned hereinbefore, the amount of the phosphatizing substance in the phosphatizing solution is exceeded by the amount of water present in such solution. Water must be present in at least an amount sufficient to provide a phosphatized coating on ferrous metal of substantial water insolubility. As is discussed in greater detail hereinbelow, this means that the coating will be, at most, about 20% water soluble. On the other hand, water may typically be present in an amount as great as water saturation of the phosphatizing solution, at the temperature of phosphatizing. However, saturation is not exceeded as the solution will then lose liquid phase homogeneity. Homogeneity as used herein refers to solution uniformity free from liquid phase separation. When water separates, the separate water phase may attract phosphoric acid into such phase, to the detriment of further coating operation.

For many phosphatizing solutions of the present invention, on the one hand water insoluble coatings are achieved, coupled with an acceptable coating weight, when the water content of the solution reaches about 1 to 2 weight percent. On the other hand, phase separation for many solutions can occur when the water content reaches only a few weight percent or more. Phosphatizing solutions of the present invention can be characterized by being non-flammable, yet having only a minor amount of water, e.g., from about 2 weight percent or less, such as only 0.1 or 0.2 weight percent. Nevertheless, these non-flammable compositions may contain on the order of 30 weight percent or more of solubilizing liquid.

Water in the solution will exert a vapor pressure; the solution water content will thereby directly influence the water content of the vapor zone associated with the solution. When such zone is over a bath of phosphatizing solution, a substantial amount of water vapor may retard the drying time of coated metal substrates that are phosphatized in the bath and then removed to the vapor zone for drying. Thus, attention to the water content of a bath might be advisable.

Basic to the "phosphatizing solution" or "phosphatizing composition" as such terms are used herein, are the organic solvent, solubilizing liquid, phosphatizing proportion of phosphoric acid, and the water. A further substance that should also be present in the phosphatizing solution is an aprotic organic substance. Although it is contemplated to use aprotic polar organic compounds for such substance, it is preferred for efficient coating operation to use dipolar aprotic organic compounds. These compounds act in the coating solution to retard the formation of an undesirable, grainy coating. The aprotic organic compound can also influence the level at which water saturation will occur in the phosphatizing compositions containing such compound, particularly when they are present in substantial amount. Although it is contemplated that such compound will always be present in minor weight amount of the phosphatizing solution, and generally present in an amount less than the amount of the solubilizing liquid, serviceable phosphatizing solutions can be prepared that contain on the order of 10 to 15 weight percent or more of such aprotic organic compound.

It is preferred, for extended retention of the aprotic organic compound in the phosphatizing solution during the phosphatizing operation, that such compound have a boiling point above the boiling point of the organic solvent in the solution. Preferably, for most extended presence in the coating solution, such compound boils at least about 20° C. higher than the organic solvent. The aprotic organic compound is often a nitrogen-containing compound; these plus other useful compounds include N,N-dimethyl formamide, dimethyl sulfoxide, acetonitrile, acetone, nitromethane, nitrobenzene, tetramethylenesulfone and their inert and homogeneous liquid mixtures where such exist. By being inert, it is meant that such mixtures do not contain substituents that will chemically react, in the phosphatizing solution, to retard desirable phosphatizing operation at the temperature attained for the solution to be at boiling condition. Dimethyl sulfoxide is useful as an aprotic organic compound; but, such may further be used as an accelerator compound, as is discussed herein below. In such case when the dimethyl sulfoxide is present as an accelerator compound, substance other than dimethyl sulfoxide is used to supply aprotic organic compound.

Another substance generally found in the phosphatizing composition is the organic accelerator compound. Such compound serves to increase the rate of formation of the coating during the phosphatizing process. Acceleration is accomplished without deleteriously affecting the nature of the coating, e.g., desirable uniform and non-grainy crystal structure for the coating. Serviceable compounds typically act in such manner even when present in the composition in very minor amount, as for example, in amount much less than 1 weight percent basis total composition weight. Advantageously, for efficient operation, the accelerator compound has a boiling point greater than the boiling point of the organic solvent. Many of the useful accelerator compounds are nitrogen-containing organic compounds. More specifically, compounds that can be, or have been, used include urea, pyridine, thiourea, dimethyl sulfoxide, dimethyl isobutylene amine, ethylenediaminetetraacetic acid and dinitrotoluene.

The use of stabilizers has been taught in the prior art and such are contemplated for use herein, such as the hydrogen and hydrogen chloride acceptor substituents that can retard the corrosive nature of phosphatizing compositions. Stabilizers against oxidation of a halohydrocarbon, for example, are also known. These might likewise assist in reducing the corrosive nature of the phosphatizing composition. Useful substances can include p-benzoquinone, p-tertiaryamyl phenol, thymol, hydroquinone and hydroquinone monomethyl ether.

The phosphatizing composition is suitable for use with any of the phosphatizing operations that can be, or have been, used with solvent phosphatizing. Solvent phosphatizing operations can provide, quickly and efficiently, dry, coated metal substrates; and thus, such operations will most always provide for quickly achieving same. Sequentially, metal articles for phosphatizing may be typically degreased in degreasing solution and then immersed in a bath of the phosphatizing composition with such bath being most always heated to boiling condition. The phosphatized article, upon removal from the bath, might best then be maintained in the vapor zone above the bath for evaporating volatile constituents from the coated article to coating dryness. During such maintenance, the article may be subjected to a spray rinse. The phosphatizing composition may also be spray applied to a metal article, such as in a vapor zone that might be formed and/or replenished by vapor from the spray composition. Other contemplated aspects of successful operation include initial rinsing of a metal article with warm rinse liquid, e.g., immersion rinsing in such liquid, wherein the liquid is formed from the constituents of the vapor from the phosphatizing solution. Such rinsing is then followed by phosphatizing, and this can be further followed by an additional rinse in the warm rinse liquid. For efficiency in all operations, the temperature of the phosphatizing composition is maintained at boiling condition. In the ambient atmosphere adjacent to the phosphatizing solution, constituents of such solution may be present in the vapor state. For convenience, this atmospheric region is thereby termed the "vapor zone".

During phosphatizing, which will take place typically in degreaser apparatus, the vapor zone, in addition to containing trace amounts of other substances, will generally be found to contain organic solvent vapor, vapor from the solubilizing liquid that solubilizes the phosphoric acid in the organic solvent, as well as water vapor. Since such substances are to be expected as the chief ingredients of the vapor zone, they are the chief ingredients of the phosphatizing composition that can be expected to be lost from such composition as vapor loss. For efficient operation, it is therefore preferred to formulate a replenishing liquid composition containing organic solvent, solubilizing liquid and water. Further, such replenishing liquid can be used for sustaining the phosphatizing composition, and may form a homogeneous and storage-stable blend before use. Thus, for convenience, this liquid is often referred to herein as the "sustaining solution." The sustaining solution can be prepared ahead, for later use after storage and/or shipment.

In the make-up of the sustaining solution, the organic solvent will be the predominant ingredient; in the balance, the solubilizing liquid will supply the major amount, with water the minor amount. Generally, the solution will contain from about 70 weight percent, to greater than 95 weight percent, of organic solvent, with above about 2 weight percent, but not more than about 25 weight percent of solubilizing liquid. The water will most always be present in the sustaining solution in an amount of about 0.4–4 weight percent. Preferably, for enhanced phosphatizing operation, the water, solubilizing liquid and organic solvent will be combined in the sustaining solution in the equivalent proportions of such substances in the phosphatizing medium vapor zone. To efficiently prepare a homogeneous sustaining solution, it is preferred to first preblend the water with solubilizing liquid. Then the organic solvent constituency may be admixed with the preblend to quickly obtain a homogeneous sustaining solution. Additional ingredients, if present, are then generally added.

These additional ingredients will be present in the sustaining solution in very minor amounts. Typically these are present in combination in an amount less than about 1–2 weight percent based on the weight of the sustaining solution. Such ingredients can include accelerator compound, stabilizer compound, aprotic organic compound and phosphoric acid. However, where such sustaining composition is prepared for extended storage, the phosphoric acid is generally not included to avoid the use of special, acid-resistant containers. Preferably, for economy, the additional ingredients are each present in an amount less than about 0.1 weight percent.

As a pre-packaged blend, the sustaining solution in addition to being useful for sustaining, may have further utility in the make-up of a fresh phosphatizing composition. When using the sustaining solution for fresh solution make-up, it has been found that typical additional ingredients for the solution make-up may also be prepared ahead in a storage-stable and uniform blend. This additional blend will generally contain, as chief ingredients, solubilizing solvent, aprotic organic compound and water. Further, such additional blend will often contain accelerator compound and stabilizer compound. Such blend is often referred to herein simply as the "precursor composition." As a precursor composition to the make-up of a fresh bath, substances are generally simply mixed together for preparing this precursor composition and then the composition is packaged for storage and/or handling. Most usually, the solubilizing solvent will comprise the major amount of this precursor composition, and the water and aprotic organic compound may be present in substantially equivalent amounts. Additional ingredients, e.g., accelerator compound or stabilizer compound, are each often present in an amount less than one weight percent, basis the weight of such precursor composition. In a typical fresh bath make-up, the precursor composition and the sustaining solution, with one or both of such generally containing accelerator plus stabilizer, are mixed together, often for use in degreasing apparatus, with phosphoric acid being added during the blending. Thus, only these two solutions plus phosphoric acid need be on hand at the inception of phosphatizing solution make-up.

After coating formation on a metal article, the article may then proceed into a vapor zone that will be supplied and replenished by vaporized substituents from the phosphatizing composition. As discussed herein before, such vapor zone may have a highly desirable make-up of organic solvent vapor, water vapor and solubilizing solvent vapor as chief constituents. Typically, as in immersion phosphatizing, the coated article may be simply removed from the phosphatizing bath into the vapor zone, maintained in such zone until dry, and then removed for subsequent operation. The constituency of the vapor zone, in addition to often supplying a desirable rinsing medium, may also form, on condensation, a stable, uniform liquid blend. This phenomenon enhances the simplicity of recirculation systems, as when coating operation is handled in degreaser apparatus. Also, such recirculation systems can be adapted to have the recirculating, condensed vapor replenished with fresh sustaining solution, which solution has been discussed hereinabove, with the resulting replenished liquid then being recirculated to the phosphatizing solution medium.

The phosphatizing composition will typically provide a desirable phosphate coating, i.e., one having a weight of 20 milligrams per square foot or more on ferrous metal, in fast operation. Although contact times for ferrous metal articles and the phosphatizing composition may be as short as 15 seconds for spray application, it will typically be on the order of about 45 seconds to three minutes for dip coating, and may even be longer. The coating weights, in milligrams per square foot, can be on the order as low as 10 to 20 to be acceptable, i.e., provide incipient corrosion protection with initial enhancement of topcoat adhesion, and generally on the order of as great as 100 to 150 although much greater weights, e.g., 300 or so, are contemplated. Preferably, for best coating characteristics including augmented topcoat adhesion and corrosion protection, the coating will be present in an amount between about 20–100 milligrams per square foot. Such coatings are readily and consistently produced with desirable coating uniformity.

The coatings that are obtained on ferrous metal will have at least substantial water insolubility, and hence are also termed herein to be "water-resistant" coatings. For determining water insolubility, the test employed is either a qualitative water-resistance test, or the more quantitative "water soak test". Both tests are described more specifically in connection with the examples. However, in general for the water soak test, or "water solubility test" as it is sometimes referred to herein, a coated ferruginous article is weighed and then immersed in distilled water. Upon removal from the water, it is rinsed in acetone and air dried. Subsequently, on re-weighing, the amount of water solubility of the coating is shown by any weight loss. This loss is generally expressed as a percentage loss of the total original coating. The method used for determining the original coating weight has been more specifically described in connection with the examples.

Advantageously, for enhanced corrosion protection, the coating will either be rated as passing the water-resistance test, or will be on the order of less than 20% water soluble as determined by the water soak test. Such a coating, for convenience, is often termed herein as a "phosphatized coating of substantial water insolubility". Preferably, for best coating performance, including the ability to receive topcoating with water-based topcoat compositions, the water solubility of the coating will be less than 5%, basis total weight of the original coating. In typical processing, the phosphatizing operation of the present invention will provide phosphatized coatings on ferruginous surfaces having virtually no water solubility as determined by the water soak test.

Because of the water resistant nature of the phosphate coating, the resulting coated metal substrates are especially adapted for further treatment with water based coating and treating systems. For example, the coated substrates may be further treated with acidified aqueous solutions typically containing a multivalent metal salt or acid in solution, such as a dilute solution of chromic acid in water. Such treating solutions can be the simplistic hexavalent-chromium-containing rinse compositions, including solutions of chromic acid and water that have been mentioned in U.S. Pat. Nos. 3,116,178 or 2,882,189, as well as their equivalent solutions such as the molybdic and vanadic acid solutions discussed in U.S. Pat. No. 3,351,504. Further, the treating solutions may be non-aqueous, it being contemplated to use chromic acid solutions such as disclosed in U.S. Pat. No. 2,927,046. The treatment can include solutions containing additional, reactive ingredients such as the combination of chromic acid and formaldehyde disclosed in U.S. Pat. No. 3,063,877. Additional treatments that are contemplated include the complex chromic-chromates from solutions typically containing trivalent chromium, as has been discussed in U.S. Pat. No. 3,279,958. Further treatments that can be used include such as the blended complex chromate salts disclosed in U.S. Pat. No. 3,864,175 as well as solutions containing salts of other metals, as exemplified in U.S. Pat. No. 3,720,547, wherein salts of manganese are employed in treating solutions. All of these treatments will generally provide a coating having a weight of from about 2 to about 40 milligrams per square foot or more. For convenience, these treatments and solutions collectively are sometimes referred to herein as "non-phosphatizing solutions for treating metal substrates".

The phosphatized coating also lends itself to topcoating from electrically deposited primers, such as the electrodeposition of film-forming materials in the well known electrocoating processes. Further, the phosphatized coatings can form the base coating for a water reducible topcoating. Such topcoating compositions typically contain solubilized polymers, similar to conventional alkyd, polyester, acrylic and epoxy types, that are typically solubilized with smaller amounts of organic amine. Also the resulting phosphate coated substrate can be further topcoated with any other suitable resin-containing paint or the like, i.e., a paint, primer, enamel, varnish or lacquer including a solvent reduced paint. Additional suitable paints can include the oil paints and the paint system may be applied as a mill finish.

Before applying the phosphate coating, it is advisable to remove foreign matter from the metal surface by cleaning and degreasing. Although degreasing may be accomplished with commercial alkaline cleaning agents which combine washing and mild abrasive treatments, the cleaning will generally include degreasing accomplished with typical degreasing solvents.

The following examples show ways in which the invention has been practiced but should not be construed as limiting the invention. In the examples all parts are parts by weight unless otherwise specifically stated. In the examples the following procedures have been employed.

PREPARATION OF TEST PANELS

Bare steel test panels, 6 × 4 inches or unless otherwise specified, and all being cold rolled, low carbon steel panels are typically prepared for phosphatizing by degreasing for 15 seconds in a commercial degreasing solution maintained at its boiling point. Dry panels are removed from the solution, permitted to dry in the vapor above the solution and are thereafter ready for phosphatizing.

PHOSPHATIZING OF TEST PANELS AND COATING WEIGHT

Unless otherwise specified, cleaned and degreased steel panels are phosphatized by immersing the panels into hot phophatizing solution maintained at its boiling point for 1 minute each. Panels removed from the solution pass through the vapor zone above the phosphatizing solution until liquid drains from the panel; dry panels are then removed from the vapor zone.

The phosphatized coating weight for selected panels, expressed as weight per unit of surface area, is determined by first weighing the coated panel and then stripping the coating by immersing the coated panel in an aqueous solution of 5% chromic acid which is heated to 160°-180° F. during immersion. After panel immersion in the chromic acid solution for 5 minutes, the stripped panel is removed, rinsed first with water, then acetone, and the air dried. Upon reweighing, coating weight determinations are readily calculated. Coating weight data is presented in milligrams per square foot (mg/ft$^2$).

EXAMPLE 1

To 434 parts of trichloro trifluoroethane there is added, with vigorous agitation, 95 parts methanol, 2.7 parts ortho phosphoric acid and 17 parts N,N-dimethyl formamide. These blended ingredients are thereafter boiled for one hour using a reflux condenser and the solution is permitted to cool. The water content of the resulting boiled solution is found to be about 0.1 weight percent. This water content is directly determined by gas chromatograph analysis of a smple wherein the column packing is Porapak Q manufactured by Waters Associates, Inc. The resulting solution is then heated to boiling and panels are phosphatized in the manner described hereinabove.

Some of the resulting coated panels, selected in sets of two with each panel in the set being coated under identical conditions for the other panel in the set, are then subjected to testing. One panel in the set is used for coating weight determination in the manner described hereinabove. The other panel in the set is subjected to the water solubility test. For this test the panel is weighed and then immersed in distilled water for 10 minutes, being maintained at ambient temperature and with no agitation. Thereafter, the test panel is removed from the water, rinsed in acetone and air dried. Subsequently, on reweighing, the amount of water solubility of the coating is shown by the weight loss. This loss, basis total original coating weight, is reported in the Table below as the percentage or degree, of coating loss.

Coating weights and water solubility of coatings, are determined initially for test panels that have been phosphatized in the above-described phosphatizing composition. Such data are determined thereafter for additional coated panels that have been phosphatized in compositions of differing water contents, all as shown in the Table below. These baths of varying water content are prepared in stepwise fashion by starting with the above-described bath, and then adding about 1 weight percent water to the bath followed by boiling the resulting solution for 1 hour. This procedure is repeated with additional water increments of 1 weight percent, as shown in the Table below. The phosphatizing coating operation for each bath of varying water content has been described hereinabove. For each phosphatizing bath, water content determinations are made prior to phosphatizing by the above-described method.

TABLE 1

| Coating Bath Water Content, Wt. % | Panel Coating Weight; mg/ft$^2$ | Degree of Solubility of Coating in Water |
|---|---|---|
| 0.1 | 25 | 52% |
| 1.1 | 35 | 14% |
| 1.3 | 39 | <5% |
| 1.4 | 37 | <5% |

The results show the enhancement in the degree of water insolubility of the phosphate coating as the water content in the phosphatizing bath increases; also, visual inspection confirms that the degree of uniformity of the phosphate coating is increasing as the water content of the phosphatizing bath increases. For this particular system, the range for the desirable water content is quite narrow, with further water addition to the bath being found to separate free water when the water content reaches only 1.6 weight percent.

A solution of 78 parts trichloro trifluoroethane, 17.07 parts methanol, 3.06 parts N,N-dimethyl formamide, 1.38 part water and 0.49 part of ortho phosphoric acid was then tested for flammability. The test used a Setaflask Tester manufactured by Stanhope-Seta Ltd. The test was run in accordance with ASTM D-3278-73. There was no flush at a temperature of 104° F., which was chosen becasue the water-trichloro-trifluoroethane azeotrope boils at 103.8° F.

EXAMPLE 2

To 1400 parts of trichloroethylene there is added, with vigorous agitation, 600 parts n-butanol, 13.65 parts ortho phosphoric acid and 3.75 parts water. These blended ingredients are heated to reflux for a few minutes. After cooling, a 705 part aliquot is taken and heated to flux.

Degreased 3 × 5 inch steel panels are phosphatized in the composition, with a 5 minute dip time, followed by rinsing in trichloroethylene. Additional phosphatizing compositions but having differing water contents as shown in the Table below, are prepared by simple water addition. Further, 18.9 parts of N,N-dimethyl formamide is added to this bath. As shown in the Table below, for each phosphatizing bath, water content determinations are made prior to phosphatizing and coating weights and water solubility testing for coatings, are determined for all phosphatized panels.

TABLE 2

| Coating Bath Water Content, Wt.% | Panel Coating Weight; mg/ft$^2$ | Degree of Solubility of Coating in Water |
|---|---|---|
| 0.312 | 18 | 17 |
| 0.354 | 38 | 4 |
| 0.396 | 64 | 6 |
| 0.438 | 99 | 6 |

Incipient phase separation of the bath occurs with the next water addition. A solution of 30 parts n-butanol and 70 parts trichloroethylene was tested for flammability as described in Exmaple 1. The test was at 187.9° F. which is the boiling point of the azeotrope of the two components. No flash resulted in the test.

We claim:

1. A non-flammable organic phosphatizing composition having a continuous and homogeneous liquid phase suitable for phosphatizing metal with a coating of at least substantial water insolubility, with said liquid phase containing water in minor amount, which composition comprises:

(A) halogenated organic solvent providing liquid phase homogeneity with an organic solubilizing liquid while being a non-solvent for a phosphatizing proportion of phosphoric acid in said composition, said halogenated organic solvent being unreactive with phosphoric acid in said composition, and having halogens selected from the group consisting of chlorine, fluorine and mixtures thereof;

(B) solubilizing liquid capable of solubilizing phosphoric acid in said composition while retaining liquid phase composition homogeneity, said solubilizing liquid being unreactive with phosphoric acid in said composition and having a boiling point greater than the boiling point of said halogenated organic solvent or forming an azeotrope with said halogenated organic solvent, wherein said azeotrope boils at a point below the boiling point of said solubilizing liquid and contains above about 80 mole percent of said halogenated organic solvent;

(C) a phosphatizing proportion of phosphoric acid; and, (D) water in an amount exceeding said proportion of phosphoric acid while being sufficient for said composition to provide a phosphatized coating of substantial water insolubility on a ferrous metal substrate in phosphatizing contact with said composition, and while retaining liquid phase homogeneity.

2. The composition of claim 1 wherein said solubilizing liquid is present in minor amount, basis weight of said halogenated organic solvent, and water is present in minor amount basis weight of said solubilizing liquid.

3. The composition of claim 1 wherein said halogenated organic solvent is a liquid at normal temperature and pressure and has a boiling point at normal pressure above about 35° C.

4. The composition of claim 1 characterized further by containing aprotic polar organic compound soluble in said composition while retaining liquid phase homogeneity, and such composition further contains water in an amount below about 2 weight percent, basis total composition weight.

5. The composition of claim 1 wherein said azeotrope contains above about 90 mole percent of said halogenated organic solvent.

6. The composition of claim 1 wherein said halogenated organic solvent is selected from the group consisting of 1,1,1-trichloroethene, trichlorethylene, perchlorethylene, trichlorofluoromethene, and trichlorotrifluoroethane.

7. The composition of claim 4 wherein said aprotic polar oragnic compound is present in minor amount basis weight of said solubilizing liquid.

8. The composition of claim 1 wherein the solubilizing liquid is selected from the group consisting of methanol, ethanol, isopropanol, n-pentanol, 2-butoxyethanol, n-proponal, n-butanol, allyl alcohol, sec-butanol, tert-butanol and their mixtures.

* * * * *